US006626738B1

(12) United States Patent
Shank

(10) Patent No.: US 6,626,738 B1
(45) Date of Patent: Sep. 30, 2003

(54) PERFORMANCE FAN NOZZLE

(75) Inventor: James Shank, Princeton, NJ (US)

(73) Assignee: Shank Manufacturing, Princeton, NJ (US)

( * ) Notice: Subject to any disclaimer, the term of this patent is extended or adjusted under 35 U.S.C. 154(b) by 0 days.

(21) Appl. No.: 10/155,729

(22) Filed: May 28, 2002

(51) Int. Cl.[7] ..... B24C 5/04
(52) U.S. Cl. ..... 451/39; 451/102
(58) Field of Search ..... 451/39, 40, 90, 451/102

(56) References Cited

U.S. PATENT DOCUMENTS

| | | | | | |
|---|---|---|---|---|---|
| 2,125,445 | A | * | 8/1938 | Holveck | 239/599 |
| 2,900,851 | A | * | 8/1959 | Rutledge | 76/101.1 |
| 4,044,507 | A | * | 8/1977 | Cox et al. | 451/38 |
| 4,545,317 | A | * | 10/1985 | Richter et al. | 114/222 |
| 4,633,623 | A | | 1/1987 | Spitz | 51/439 |
| 4,843,770 | A | | 7/1989 | Crane et al. | 51/439 |
| 5,319,894 | A | * | 6/1994 | Shank, Jr. | 451/102 |
| H1379 | H | | 12/1994 | Meuer | 451/38 |
| RE34,854 | E | | 2/1995 | Shank, Jr. | 451/102 |
| 5,421,766 | A | | 6/1995 | Shank, Jr. | 451/75 |
| 5,484,325 | A | * | 1/1996 | Shank | 451/38 |
| 5,487,695 | A | * | 1/1996 | Shank | 451/102 |
| 5,579,999 | A | * | 12/1996 | Seiner et al. | 239/265.11 |
| 5,626,508 | A | * | 5/1997 | Rankin et al. | 451/102 |
| 5,660,580 | A | * | 8/1997 | Lehnig | 451/38 |
| 5,704,825 | A | | 1/1998 | LeCompte | 451/102 |
| 5,707,214 | A | * | 1/1998 | Schmidt | 417/109 |
| 5,779,523 | A | * | 7/1998 | Mesher | 451/93 |
| 5,795,626 | A | * | 8/1998 | Gabel et al. | 427/458 |
| 5,975,996 | A | * | 11/1999 | Settles | 451/102 |
| 6,168,503 | B1 | * | 1/2001 | Pao et al. | 451/40 |
| 6,224,463 | B1 | * | 5/2001 | Hartzell, Jr. | 451/40 |
| 6,293,857 | B1 | | 9/2001 | Allard | 451/102 |
| 6,417,126 | B1 | * | 7/2002 | Yang | 501/127 |

FOREIGN PATENT DOCUMENTS

| | | | | |
|---|---|---|---|---|
| DE | 3622292 | A1 * | 1/1987 | B24C/5/04 |

* cited by examiner

*Primary Examiner*—Joseph J. Hail, III
*Assistant Examiner*—David B. Thomas
(74) *Attorney, Agent, or Firm*—Stuart D. Frenkel

(57) ABSTRACT

A blast nozzle is provided with a converging inlet portion, a venturi orifice and a diverging fan-shaped outlet portion. The converging inlet portion and orifice have a round cross section and the diverging fan-shaped outlet portion has an elliptical cross section from beyond the orifice to an outlet.

21 Claims, 2 Drawing Sheets

PERFORMANCE FAN NOZZLE

FIELD OF THE INVENTION

The present invention relates generally to improved blast nozzles for removing adherent material such as paint, scale, dirt, grease and the like from solid surfaces with abrasive particles propelled by air. In particular, the present invention is directed to a novel blast nozzle having a specified shape and dimensions to improve blast-cleaning efficiency.

DESCRIPTION OF THE PRIOR ART

In order to clean a solid surface so that such surface can again be coated such as, for example, to preserve metal against deterioration, or simply to degrease a solid surface such as surfaces contacting food or building structures which contain food serving or food processing operations, it has become common-practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove the coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used.

A typical dry blasting apparatus as well as a wet blasting apparatus which utilizes highly pressurized air to entrain, carry and direct the abrasive blast media to the solid surface to be treated and low pressure water for dust control comprises a dispensing portion in which the blast media typically contained in a storage tank is entrained in highly pressurized air, a flexible hose which carriers the air/blast media mixture to the blast nozzle and which allows the operator to move the blast nozzle relative to the surface to be cleaned and the blast nozzle which accelerates the abrasive blast media and directs same into contact with the surface to be treated. The blast nozzle is typically hand-held by the operator and moved relative to the targeted surface so as to direct the abrasive blast media across the entire surface to be treated.

The blast media or abrasive particle most widely used for blasting surfaces to remove adherent material is sand. Sand is a hard abrasive that is very useful in removing adherent materials such as paint, scale and other materials from metal surfaces such as steel. While sand is a most useful abrasive for each type of blasting technique, there are disadvantages in using sand as a blast media. For one, sand, i.e. silica, is friable and upon hitting a metal surface will break into minute particles that are small enough to enter the lungs. The minute silica particles pose a substantial health hazard. Additionally, much effort is needed to remove the sand from the surrounding area after completion of blasting. Still another disadvantage is the hardness of sand itself. Thus sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals such as aluminum, composite surfaces, plastics, concrete and the like is sodium bicarbonate. While sodium bicarbonate is softer than sand, it is sufficiently hard to remove coatings from aluminum surfaces and as well remove other coatings such as paint, dirt, and grease from non-metallic surfaces without harming the substrate surface. Sodium bicarbonate is not harmful to the environment and is most advantageously water-soluble such that the particles that remain subsequent to blasting can be simply washed away without yielding environmental harm.

Sodium bicarbonate blast media has been directed to the targeted surface by means of venturi-type blast nozzles typically used for directing harder abrasive media such as sand. Such blast nozzles include a hollow converging inlet portion, a venturi orifice and a diverging hollow outlet portion downstream of the orifice. Since the sodium bicarbonate blast media is less dense than sand or other hard abrasive media, the blast nozzles used to direct sand do not necessarily have the proper dimensions for accelerating the sodium bicarbonate media there through to provide the optimum velocity and most productive cleaning. It therefore, would be advantageous to design a blast nozzle which would be most useful for blast cleaning with less dense media such as sodium bicarbonate so as to obtain optimal cleaning productivity with such blast media.

It has been suggested previously that by increasing the length of the nozzle, productivity can be increased at least with respect to blasting with sand. Unfortunately, the blast nozzles used for propelling sand against a targeted surface must be formed of very heavy ceramic material to withstand the abrasive nature of the sand. Longer nozzles simply are not practical since by lengthening the nozzle, the weight of the nozzle would be greatly increased making hand-held operation of such nozzles extremely difficult. In addition, the cost would be excessive and the nozzles would be fragile and subject to breakage. Using a softer sodium bicarbonate blast media, however, allows the use of substantially lighter materials of construction to form the blast nozzle. For example, very thin stainless steel can be used to form the blast nozzle. The blast nozzle can now be lengthened without adding excessive weight thereto. Hand-held operation is now practical and a substantially improved productivity can be achieved whether dry blasting or atomized water blasting is used. The present inventor has disclosed in U.S. Pat. No. 5,484,325 that in those blast nozzles comprising a converging inlet, a venturi throat and a diverging outlet, providing the blast nozzle with a total length of at least about four times, preferably at least five times and, more preferably, at least about six times the length of the inlet, substantially improved production can be achieved by blasting with sodium bicarbonate. This improved productivity has been found whether during dry blasting or utilizing dry blasting with atomized water for dust control.

Further disclosed in aforementioned U.S. Pat. No. 5,484,325 is that optimal productivity for blast cleaning a surface with a softer, less dense blast media such as sodium bicarbonate can be achieved by a venturi-type blast nozzle characterized more specifically than by the mere relative total length to inlet length of the blast nozzle. As disclosed therein, it was found that optimal productivity can be achieved if the outlet length, that being the length of the venturi-type nozzle immediately downstream of the orifice (throat) to the outlet of the nozzle is approximately 20 times the diameter of the orifice. Generally, it was found that an outlet length that is 18 to 24 times the orifice diameter provides optimal productivity. At outlet lengths below the range cited, productivity is adversely affected. At lengths above the range, productivity is no longer improved or may be adversely affected. Along with the outlet length, optimal productivity is achieved if the outlet diameter is approximately 1.5 times the orifice diameter. Deviations of more than 10% below this parameter adversely affect productivity. Thus, the outlet diameter should be at least 1.35 times the orifice diameter. Deviations above 1.65 times the orifice diameter do not show benefits at media flow rates typically used to blast with sodium bicarbonate, i.e., 2–4 lbs./min. At higher flow rates, larger nozzle outlets may show productivity improvements.

As further disclosed in U.S. Pat. No. 5,484,325, with softer and friable blast media, passage through the converging inlet section of the venturi-type blast nozzle often degrades the particles of the media, creating particles of smaller mass and often causing turbulent flow in the inlet section thereby reducing the velocity of the particles as they travel through the blast nozzle. The loss of mass and velocity reduces the force of the particle on the targeted surface and, thus, can reduce productivity of the nozzle. Thus, the converging inlet section of a blast nozzle for directing the softer abrasive media should converge at a relatively minor angle, typically from between about 5° to 15° from horizontal, preferably, approximately 10°. To further eliminate turbulent flow, the diameter of the inlet should be approximately equivalent to the inside a diameter of the blast hose which supplies the blast media to the nozzle. Preferably, the inlet diameter should not deviate more than approximately 25% plus or minus from the inlet diameter of the supply hose. The longitudinal length of the orifice is optimum at lengths about equivalent to the orifice diameter. Larger orifice lengths have not been found to yield any significant improvement in productivity.

While the nozzle parameters as described above have been optimized for improving blast cleaning with a soft media such as sodium bicarbonate, the formation of blast nozzles from a hard ceramic allow such nozzles to be used for blast cleaning with harder, more dense substances, either added with the softer abrasive or as the sole abrasive agent. It is believed that the parameters described above improve productivity of blast cleaning using the harder, more dense abrasive media even though the exact ratios of nozzle length to orifice diameter, outlet diameter to orifice diameter, etc. as described above may not yield the optimum productivity with these abrasives.

As disclosed in U.S. Pat. No. 5,484,325, the parameters for improving the performance of blast nozzles as described, define nozzles having a circular cross-section (round nozzle) of specified orifice and outlet areas and angle of divergence in the outlet section. Thus, it is stated that the dimensions of a nozzle of any cross-section can be calculated based on the described ratios. No further explanation is provided, however.

A standard round nozzle comprises a converging hollow conical inlet section, a circular venturi throat and a contiguous diverging hollow conical outlet section. The standard round nozzle is highly productive inasmuch as it provides for the maximum acceleration of the abrasive particles through the nozzle relative to other nozzle shapes. This is in part due to the fact that the circular cross section yields the smallest internal nozzle surface area, thus, greatly reducing friction between the expanding air containing the abrasive media and the internal surfaces of the nozzle. Contact of the air/abrasive mix with the internal surfaces of the nozzle can result in deceleration of the abrasive particles and consequent reduction in blast cleaning effectiveness. While the circular cross section of the round nozzle yields the smallest internal surface area, the "hotspot", that being the area of the target surface which is contacted at one time with the media, produced by the round nozzle is rather compact. For cleaning large surface areas, the use of a round nozzle may be quite inefficient due to the reduced size of the hotspot, despite the fact that the abrasive media is being optimally accelerated through the nozzle and directed to the target surface. Accordingly, to clean large surface areas, it has been proposed to alter the blast nozzle shape, in particular, reconfigure the shape of the nozzle outlet so as to provide a larger hotspot and reduce cleaning time.

One such nozzle configuration is characterized as a fan nozzle in which the outlet section of the nozzle downstream of the venturi orifice diverges outwardly in two directions so as to provide the nozzle outlet with a fan-type shape. A fan nozzle has been developed specifically for blast cleaning with sodium bicarbonate. Thus, the present inventor of U.S. RE. Pat. No. 34,854, discloses a blast nozzle particularly useful in blasting with soft and friable media such as sodium carbonate and which nozzle can be characterized as a fan nozzle. The fan nozzle comprises a continuous longitudinal passageway comprising an inlet portion, which converges in a single planar axis, a rectangular venturi throat or orifice and an outlet portion, which diverges also in a single planar axis, which is perpendicular to the axis of convergence of the inlet portion. The converging passage in the inlet portion is formed by opposed modular triangular ramps, which can be removed and replaced with other ramps, which are longer or shorter so as to maximize the speed of the blast media and adjust the blast nozzle to readily accommodate different types of blast media operating conditions so as to maintain optimal productivity. The inlet portion of the fan nozzle is rigid, rectangular, and is sufficiently long that the length of the inlet portion of the blast nozzle is greater than twice the inside diameter of the blast nozzle inlet. The width of the orifice is the same as the diameter of the inlet. The longer convergence and avoidance of immediate expansion as the blast media/air stream enters the nozzle provides improved streamline flow, less turbulence and less mass loss in the individual abrasive particles. The outlet portion is also of modular construction comprising releasable attached upper and lower fan-shaped expansion sections which can be replaced to change the expansion ratio or angle of divergence of the nozzle and thus allows the nozzle to be adjusted to accommodate the specific media being used and changing on-site conditions.

The cross section of the outlet of the fan nozzle described in U.S. RE. Pat. No. 34,854 is rectangular. The rectangular cross section of the outlets of fan nozzles is typical of this blast nozzle configuration. Unfortunately, the rectangular cross section of the outlet provides a large internal nozzle surface area relative to the same cross sectional area of a round nozzle, thus, increasing drag on the expanding air and abrasive particles being directed through the nozzle. The increased drag reduces abrasive particle speed. Thus, while round nozzles produce a high intensity blast pattern in a small round area, the fan nozzle produces a lower intensity blast pattern over an elongated area. Depending on the application, a fan nozzle with lower particle speed can be more productive than a round nozzle with high particle speed depending upon the surface to be cleaned and the coating material to be removed.

Round nozzle geometry for producing the maximum nozzle efficiency, in particular, with softer blast media such as sodium bicarbonate has been defined as disclosed in aforementioned U.S. Pat. No. 5,484,325. However, little work has been focused on transferring the optimization of the round nozzle to optimize the fan nozzle efficiency and, in particular, to overcome the excessive drag which results utilizing the rectangular cross sectional dimensions typically used in fan nozzle configurations.

Accordingly, it is the object of the present invention to provide a novel fan nozzle design, as well to provide a fan nozzle geometry that provides for optimum blast cleaning efficiency when utilizing such fan nozzles for cleaning a targeted surface.

SUMMARY OF THE INVENTION

The round nozzle geometry yields a linear taper increasing uniformly in the X-Y and X-Z planes from the nozzle throat to the nozzle outlet with a uniform circular-cross section (Y-Z plane). The optimum linear taper is provided by the ratios with respect to outlet length to diameter of the orifice and outlet diameter relative to the orifice diameter as previously described in U.S. Pat. No. 5,484,325.

In accordance with the present invention, the optimum X-Y and X-Z plane geometries can be defined for a fan nozzle of specific throat diameter and outlet width by matching the cross sectional areas along the fan nozzle outlet section length to a round nozzle of the same throat diameter and outlet section length. Since the round nozzle represents the minimum internal surface area design for a particular size nozzle, a fan nozzle of the same size (length) will have a greater internal surface area and produce more drag. Increasing fan nozzle outlet width increases surface area and associated drag. Comparing the internal surface areas as a ratio between the same size round and fan nozzles can be used to predict performance or efficiency of a particular fan nozzle design. Thus, the present invention attempts to create a fan nozzle which has the improved productivity of a round nozzle of the same size by matching the cross sectional areas of the diverging outlet portion of the fan nozzle with the cross sectional areas of the outlet section of a round nozzle of optimum performance as previously described in the inventors aforementioned patent.

It has been found that the most efficient fan nozzle has an outlet portion having a cross-sectional shape (Y-Z plane) that is a classic ellipse, where the cross sectional area equals that of the corresponding position along the length of a round nozzle having the same size and configured for optimal performance as previously described. The outlet portion has a cross-section that is round at the nozzle throat and becomes progressively flatter in the Y dimension and uniformly wider in the Z dimension as the nozzle length increases in the X dimension to the nozzle outlet. The X-Z plane taper from the centerline of the nozzle is linear, increasing uniformly from the throat diameter to the nozzle outlet. The X-Y plane curve (from centerline) can be described by a polynomial equation.

DETAILED DESCRIPTION OF THE INVENTION

Figure 1:
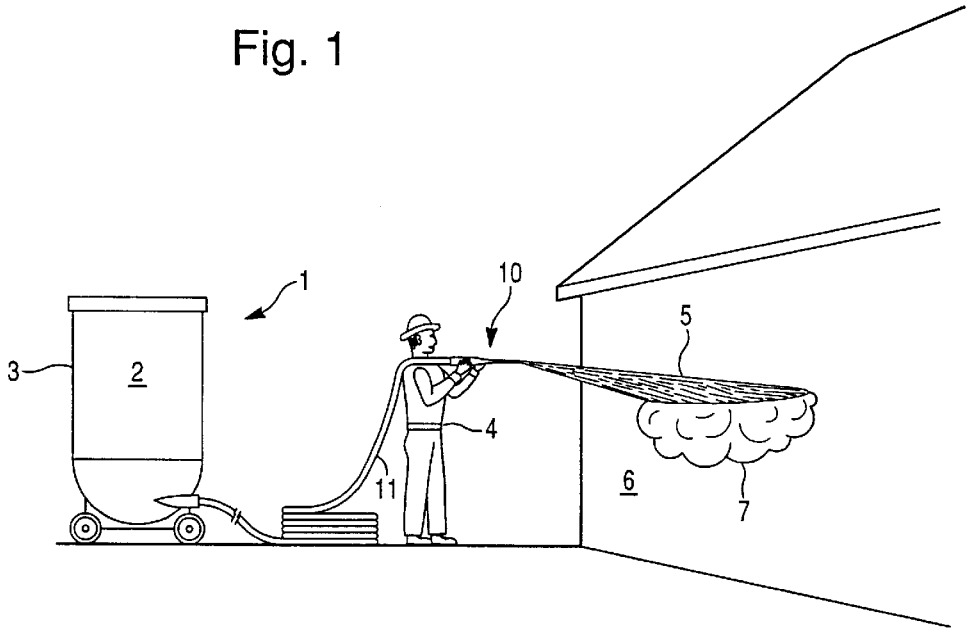
FIG. 1 is a schematic representation of a blast system using the blast nozzle of the present invention.

Referring initially to FIG. 1, a typical air-propelled abrasive blast system includes a blast nozzle 10 that is connected to the outer end of a high pressure flexible supply hose 11, which carries the blast media mixed with air from dispensing device 2 to the inlet of blast nozzle 10. A normally closed "deadman" control valve (not shown) is mounted adjacent the blast nozzle 10 and functions to prevent operation of the blast nozzle unless the control valve is held open by depressing a spring-loaded lever.

Dispensing device 1 generally includes a supply of abrasive particles 2, such as sand or, more particularly, sodium bicarbonate, contained in a tank or pot 3, which is sized to hold a selected quantity of abrasive. Compressed air applied to tank 3 carries the blast media to supply hose 11. The flow of abrasive blast media from tank 3 through supply hose 11 is typically controlled via a metering and shut-off valve (not shown). The supply hose 11 extends from the tan 3 and typically is passed over the shoulder of the operator designated by reference numeral 4 and is connected to blast nozzle 10. There are various means to meter the abrasive blast media into the compressed air stream and any of such metering devices are operable in the present invention. A metering device that utilizes differential air pressure is described in U.S. Pat. Nos. 5,081,799 and 5,083,402, herein incorporated by reference.

As shown in FIG. 1, exiting blast nozzle 10 is a stream of abrasive blast particles entrained in a pressurized air stream indicated by reference numeral 5 and which contacts surface 6. As the abrasive blast particles contact surface 6, these particles strip the coating, dirt, etc. from the surface and a long with this stripped material are deflected from the surface 6 in a direction opposite to the direction of the stream issuing from the nozzle 10. The abrasive blast media, which is often friable breaks into smaller pieces as it contacts surface 6 and forms a dust cloud 7 as the particles are deflected from surface 6. Atomized water may optionally be directed at the cloud of dust 7 to coalesce the dust particles and cause such particles to precipitate to the ground to suppress the formation of dust cloud 7 and prevent the dispersion of the dust particles away from surface 6 and into the surrounding environment. Any source of atomized water may be useful to suppress dust.

Figure 2:
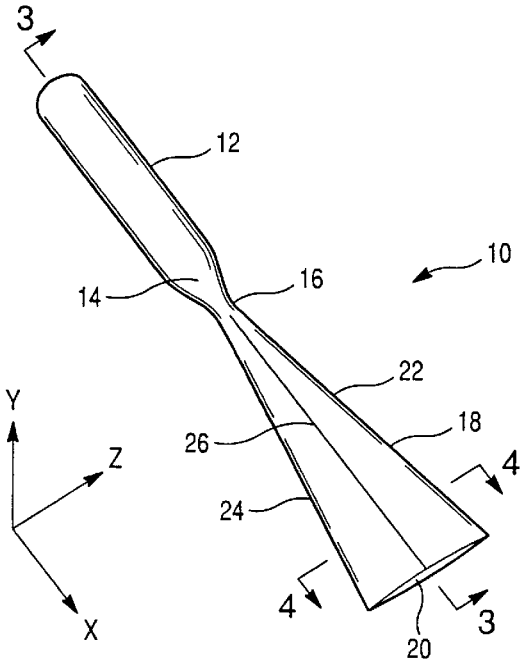
FIG. 2 is a perspective view of the fan nozzle of the present invention.
Figure 3:
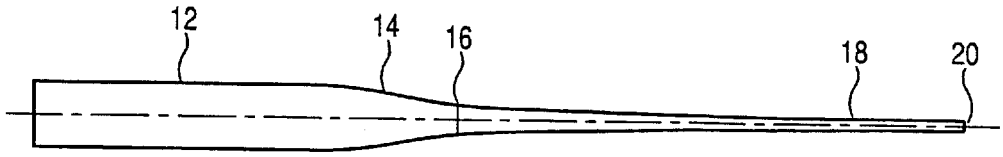
FIG. 3 is a cross section of the fan nozzle of FIG. 2 taken through line 3—3 of FIG. 2.
Figure 4:
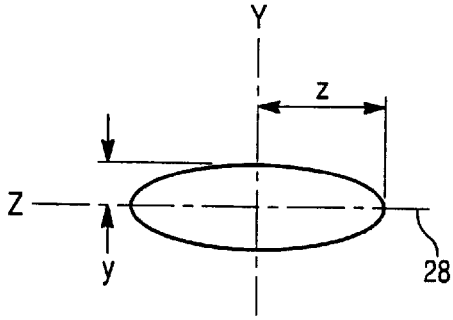
FIG. 4 is a cross section of the outlet portion of the fan nozzle taken through line 4—4 of FIG. 2.
Figure 5:
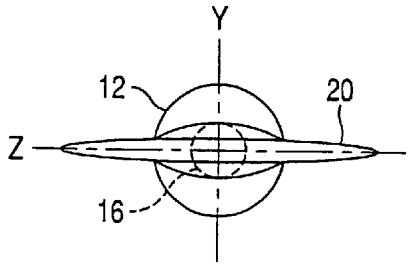
FIG. 5 is a view showing the relative sizes of the inlet, throat, and outlet of the fan nozzle of this invention.

The fan nozzle of t he present invention can be described by referring to FIGS. 2 and 3. As shown therein, the fan nozzle 10 includes a constant area round hollow inlet section 12 that converges at 14 to a hollow throat 16. The cross sectional (Y-Z plane) of inlet section 12, converging section 14 tan throat 16 are circular. From throat 16, the outlet section 18 is flattened into an expanding, hollow, fan-shaped portion as shown in FIG. 1. The cross sectional area (Y-Z plane) of outlet section 18 anywhere beyond throat 16 to the outlet 20 is in the form of a classical ellipse as shown in FIG. 4. The cross section is round at nozzle throat 16 and becomes progressively flatter in the Y dimension and uniformly wider in the Z dimension as the nozzle length increases from throat 16 to outlet 20 in the X dimension. The X-Z plane taper from centerline 26 of outlet section 18 is linear, increasing uniformly from throat 16 to outlet 20. Thus, lateral sides 22 and 24 of outlet section 18 diverge linearly from throat 16. Importantly, the X-Y plane taper from center line 28 of outlet section 18 from throat 16 to outlet 20 is a curve which can be described by a polynomial equation, preferably, by a fifth order polynomial, i.e. $Y=(A)X^5+(B)X^4+(C)X^3+(D)X^2+(E)X+(F)$. The relative sizes of the cross sectional areas (Y-Z plane) of linear inlet 12, throat 16 and outlet 20 can be seen in FIG. 5.

The dimensions of the fan nozzle 10 of the present invention can be optimized by a consideration of the dimensions of a round nozzle of the same size and designed for optimum N performance as described in U.S. Pat. No. 5,484,325. As disclosed therein, the dimensions of the round nozzle were provided to optimize blast cleaning with a relatively soft abrasive such as sodium bicarbonate. Thus, the internal geometry of the round performance nozzle was deformed by a formula that described the critical outlet section geometry in relation to the throat diameter. The fan nozzle of the present invention and, in particular, the fan nozzle outlet section 18, is designed herein to control the expansion of compressed air as it converts from pressure to velocity at the same rate as the round performance nozzle as described in U.S. Pat. No. 5,484,325. Thus, the internal volume of outlet section 18 of the fan nozzle must be equal to the internal volume of the outlet section of the round performance nozzle. In other words, the elliptical cross-sectional area of the fan nozzle outlet section 18 at any position along its length X from throat 16 to outlet 20 must equal the round cross-sectional area of the corresponding outlet section position along the length of the round performance nozzle.

Accordingly, like the round nozzle described in U.S. Pat. No. 5,484,325, the dimensions of the fan nozzle 10 of the present invention can be defined directly or indirectly by certain critical ratios. These ratios include the outlet section length ratio (LR), which is the ratio of the length of the outlet section 18 from throat 16 to outlet 20 relative to the diameter of the orifice or throat 16. The outlet ratio (OR) as used in U.S. Pat. No. 5,484,325 to describe the round nozzle outlet diameter corresponding to outlet 20 of FIG. 2, relative to the diameter of the round nozzle orifice, corresponding to orifice 16 in FIG. 2 can be used to indirectly define the height Y of outlet section 18 anywhere along the length X of outlet section 18. In accordance with this invention, the outlet section length ratio (LR) directly describes the fan nozzle outlet section length and ranges between 15–25, meaning that the length of the outlet section 18 from venturi throat 16 to outlet 20 is 15–25 times the diameter of venturi orifice 16. The outlet ratio (OR) used in U.S. Pat. No. 5,484,325 to define the ratio of round nozzle outlet diameter relative to orifice diameter and ranging from 1–2, meaning that the round nozzle outlet diameter is 1 to 2 times the diameter of venturi orifice indirectly defines the fan nozzle outlet section cross-sectional area, and therefore defines the height of Y shown in FIG. 4 for any fixed Z shown in FIG. 4, anywhere along the length of X of outlet section 18 from the venturi throat 16 to outlet 20. When applied to the fan nozzle, the Outlet Ratio (OR) describes the ratio of the diameter of a circle having an equivalent cross-sectional area to that of the elliptical cross-section of outlet 20 to the diameter of orifice 16.

For any defined (user selected or specified) outlet width 20, the outlet section width (Z) of the fan nozzle becomes uniformly wider in the Z dimension as length (X) increases from throat 16 towards outlet 20. The taper or diverging angle of outlet section 18 is constant and linear and it is the slope of the X-Z plane line that describes the width of the fan nozzle from the centerline 26 of the fan nozzle outlet section 18. An equation to describe width (z) from center line 26 of the outlet section 18 of fan nozzle 10 anywhere along the length (X) in the X-Z pane can be derived using a linear equation with a slope equal to the taper of outlet section 18.

$$\underset{\text{(From centerline 26)}}{\text{Outlet Section Width } (z)_{@x}} = \text{(Outlet Section Width Taper) } X + \text{(Throat Diameter) } 0.5 \quad (1)$$

Substituting for the Outlet Section Width Taper in terms of the LR ratio defined in U.S. Pat. No. 5,484,325:

$$\underset{\text{(From centerline 26)}}{\text{Outlet Section Width } (z)_{@x}} = \text{(Outlet Width/Throat Diameter} - 1)X/2LR + \text{(Throat Diameter) } 0.5 \quad (2)$$

The cross sectional shape (Y-Z plane) of outlet section 18 of fan nozzle 10 is a classical ellipse that is round at the nozzle throat and become progressively flatter in the y dimension from center line 28 as the length of outlet section 18 increases in the X direction from venturi throat 16 to nozzle outlet 20. An equation to describe the height (y) from centerline 28 of outlet section 18 anywhere along the length (X) in the X-Y plane can be derived by setting the elliptical cross-sectional area of the fan nozzle equal to the round cross-sectional area of the round performance nozzle as described in U.S. Pat. No. 5,484,325. Accordingly, the outlet section height (y) from centerline 28 (FIG. 4) at any distance X from throat 16 is as follows:

$$\underset{\text{(From centerline 28)}}{\text{Outlet Section } (y)_{@x}} = [(OR-1)X/LR + \text{Throat Diam.}]^2 / 4[(\text{Outlet Width/Throat Diam.} - 1)X/2LR + \text{(Throat Diameter) } 0.5] \quad (3)$$

The blast nozzle of the present invention can advantageously be used with any type of friable blast media. Thus, while it has been disclosed that the blast nozzle of the present invention is most useful with soft friable blast media such as sodium bicarbonate, the blast nozzle apparatus is also useful with a hard friable blast media such as sand. The blast nozzle apparatus of this invention is useful to remove coatings, scale, dirt, grease and the like from any type of surface including the softer surfaces describe above such as soft metals including aluminum and plastic surfaces and, as well, hard surfaces such as hard metals including steel.

While stainless steel nozzles can be used to direct soft blast media such as sodium bicarbonate to a targeted surface, for certain applications it may be useful to include a minor amount of a hard abrasive with the softer bicarbonate abrasive. Thus, a useful blast media may comprise a major amount of a soft abrasive such as sodium bicarbonate with a minor amount of a hard abrasive such aluminum oxide to remove contaminants from a steel surface. The hard abrasive allows a profile to be placed on the targeted surface, which can then be repainted. Unfortunately the hard abrasive even though present in minor amounts tends to erode the internal surfaces of a stainless steel nozzle. Accordingly, the nozzle of the present invention may also be formed of a hard ceramic substance having the parameters described above. Thus, the interior surface of the blast nozzle can be formed from tungsten carbide, silicone carbide, boron carbide, silicone nitride, etc. or any other hard material which is abrasion resistant especially to hard abrasive blast media such as sand, aluminum oxide and other ceramic blast media. Instead of forming the whole nozzle from the ceramic material the interior portions of the nozzle can be formed from a ceramic liner composed of any of the materials described above. Surrounding the ceramic liner can be a plastic encapsulating coat to prevent breakage of the ceramic liner and provide improved impact strength to the blast nozzle. Such a nozzle is described in U.S. Pat. No. 5,484,325. The encapsulating coat can be formed from any high impact plastic, for example, a polyurethane resin. Due to its complex geometric shape, it may also be advantageous to form the fan nozzle from a molding process using an epoxy or similar resin impregnated with hard abrasion resistant materials.

While the nozzle parameters as described above have been optimized form improving blast cleaning with a soft media such as sodium bicarbonate, the formation of blast nozzle from a hard ceramic allow such nozzle to be used with harder, more dense substances either added with the softer abrasive or as the sole abrasive agent. It is believed that the parameters for the fan nozzle as described above will improve productivity of blast cleaning using the harder, more dense abrasive media even though the exact ratios of nozzle length to orifice diameter, outlet diameter to orifice, etc. as described above may not yield the most optimum productivity with these abrasives.

What is claimed:

1. A fan nozzle for directing a stream of abrasive particles against a targeted surface for the removal of surface contaminants therefrom comprising:

a hollow converging inlet portion, a downstream hollow diverging outlet portion which diverges to an outlet from a venturi orifice placed intermediate of said converging and diverging portions, said orifice having a circular cross section and said hollow diverging outlet portion having an elliptical cross section at any point from beyond said orifice to said outlet.

2. The fan nozzle of claim 1 wherein the cross section of said outlet portion is progressively smaller in the Y dimension and uniformly wider in the Z dimension along the X dimension of said outlet portion from said orifice to said outlet, wherein the X dimension is length, the Y dimension is height and the Z dimension is width.

3. The fan nozzle of claim 1 wherein the width of said outlet portion in the Z direction increases linearly from said orifice to said outlet.

4. The fan nozzle of claim 3 wherein the height of said outlet portion from said orifice to said outlet in the X-Y plane is a curve which can be defined by a polynomial equation.

5. The fan nozzle of claim 4 wherein said curve can be defined by a fifth order polynomial equation.

6. The fan nozzle of claim 1 wherein upstream of said hollow converging portion is an inlet hollow portion having a constant cross-sectional area.

7. The fan nozzle of claim 1 wherein the length of said outlet portion from said orifice to said outlet is 15–25 times the diameter of said orifice.

8. The fan nozzle of claim 7 wherein the length of said outlet portion from said orifice to said outlet is about 20 times the diameter of said orifice.

9. The fan nozzle of claim 1 wherein the cross-sectional area of said outlet is equivalent to that of a circle having a diameter 1–2 times the diameter of said orifice.

10. The fan nozzle of claim 7 wherein the cross-sectional area of said outlet is equivalent to that of a circle having a diameter 1–2 times the diameter of said orifice.

11. A fan nozzle for directing a stream of abrasive particles against a targeted surface for the removal of surface contaminants therefrom comprising:

a hollow converging inlet portion, a fan-shaped hollow, diverging outlet portion which diverges to an outlet from a venturi orifice placed intermediate of said converging and diverging portions, said fan-shaped diverging outlet portion having a width Z from the longitudinal centerline of said fan-shaped diverging outlet portion anywhere along the length X of said outlet portion from said orifice to said outlet defined by the equation:

$$\text{Outlet Section Width } (z)_{@x} = \text{(From Centerline)}, \quad (\text{Outlet Width}/\text{Orifice Diameter} - 1)X/2LR + (\text{Orifice Diameter})\ 0.5$$

wherein LR is the ratio of the length of the outlet section from said orifice to said outlet relative to the diameter of said orifice.

12. The fan nozzle of claim 11 wherein LR ranges from 15–25.

13. The fan nozzle of claim 12 wherein LR equals 20.

14. The fan nozzle of claim 11 wherein the height (y) of said outlet portion from a centerline dividing said outlet at any distance (X) downstream from said orifice is defined as follows:

$$\text{Outlet Section } (y)_{@x} = [(OR-1)X/LR + \text{Orifice Diameter}]^2 / 4[(\text{Outlet Width}/\text{Orifice Diameter} - 1)X/2LR + (\text{Orifice Diameter})\ 0.5]$$

wherein OR is the ratio of the diameter of a circle having an equivalent cross-sectional area to that of the elliptical cross-section of said outlet to the diameter of said orifice.

15. The fan nozzle of claim 14 wherein the cross-sectional area of said outlet is equal to a cross-sectional area having a diameter ranging from 1 to 2 times that of said orifice.

16. The fan nozzle of claim 14 wherein the cross-sectional area of said outlet is equal to a cross-sectional area having a diameter of 1.5 times that of said orifice.

17. A process for removing contaminants from the surface of a solid substrate comprising:

directing at said substrate a stream of sodium bicarbonate particles capable of stripping said contaminants from said surface upon contact therewith, said sodium bicarbonate particles being directed at said substrate by a blast nozzle comprising a hollow converging inlet portion, a downstream hollow diverging outlet portion which diverges to an outlet from a venturi orifice placed intermediate of said converging and diverging portions, said orifice having a circular cross section and said hollow diverging outlet portion having an elliptical cross section at any point from beyond said orifice to said outlet.

18. The process of claim 17 wherein the cross section of said outlet portion is progressively smaller in the Y dimension and uniformly wider in the Z dimension along the X dimension of said outlet portion from said orifice to said outlet, wherein the X dimension is length, the Y dimension is height and the Z dimension is width.

19. The process of claim 17 wherein the height of said outlet portion from said orifice to said outlet in the X-Y plane is a curve which can be defined by a polynomial equation.

20. The process of claim 17 wherein the length of said outlet portion from said orifice to said outlet is 15–25 times the diameter of said orifice.

21. The process of claim 17 wherein the cross sectional area of said outlet is equivalent to a round cross-sectional area having a diameter ranging from 1–2 times the diameter of said orifice.

* * * * *